US006463250B1

(12) United States Patent
Chen et al.

(10) Patent No.: US 6,463,250 B1
(45) Date of Patent: Oct. 8, 2002

(54) EXTERNALLY HEATED DEFORMABLE FUSER ROLLER

(75) Inventors: Jiann-Hsing Chen, Fairport; Arun Chowdry; John W. May, both of Rochester; Borden H. Mills, Webster; David Quesnel, Rochester; Donald S. Rimai, Webster, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/679,345

(22) Filed: Oct. 4, 2000

(51) Int. Cl.[7] ..... G03G 15/20
(52) U.S. Cl. ..... 399/330; 399/333
(58) Field of Search ..... 399/330, 328, 399/333; 219/216

(56) References Cited

U.S. PATENT DOCUMENTS

| | | | | | |
|---|---|---|---|---|---|
| 3,666,247 | A | * | 5/1972 | Banks | 432/60 |
| 3,854,975 | A | * | 12/1974 | Brennman et al. | 430/98 |
| 3,863,603 | A | | 2/1975 | Beckley et al. | 118/637 |
| 3,959,574 | A | | 5/1976 | Seanor et al. | 428/425 |
| 3,983,287 | A | | 9/1976 | Goosen et al. | 428/241 |
| 4,023,967 | A | | 5/1977 | McGibbon | 96/1 LY |
| 4,255,508 | A | | 3/1981 | Kuehnle | 430/94 |
| 4,372,246 | A | * | 2/1983 | Azar et al. | 118/60 |
| 4,378,622 | A | | 4/1983 | Pinkston et al. | 29/148.4 D |
| 4,531,825 | A | | 7/1985 | Miwa et al. | 355/3 TR |
| 4,601,963 | A | | 7/1986 | Takahashi et al. | 430/69 |
| 4,791,275 | A | | 12/1988 | Lee et al. | 219/469 |
| 4,899,197 | A | | 2/1990 | Davis et al. | 355/290 |
| 4,994,827 | A | * | 2/1991 | Jamzadeh et al. | 346/157 |
| 5,038,178 | A | | 8/1991 | Hosoya et al. | 355/277 |
| 5,143,573 | A | | 9/1992 | Ammon et al. | 156/294 |
| 5,227,853 | A | | 7/1993 | Prouix et al. | 355/282 |
| 5,258,809 | A | | 11/1993 | Wiedemer | 355/200 |
| 5,298,956 | A | | 3/1994 | Mammino et al. | 355/275 |
| 5,335,054 | A | | 8/1994 | Lands et al. | 355/279 |
| 5,376,999 | A | | 12/1994 | Hwang | 355/326 R |
| 5,386,273 | A | | 1/1995 | Wood et al. | 355/212 |
| 5,415,961 | A | | 5/1995 | Yu et al. | 430/58 |
| 5,418,600 | A | | 5/1995 | Genovese | 355/200 |
| 5,438,398 | A | | 8/1995 | Tanigawa et al. | 355/271 |
| 5,497,222 | A | | 3/1996 | Landa et al. | 355/279 |
| 5,508,789 | A | | 4/1996 | Castelli et al. | 355/208 |
| 5,519,475 | A | | 5/1996 | Miyamoto et al. | 355/271 |
| 5,553,541 | A | | 9/1996 | Vrotacoe et al. | 101/217 |
| 5,592,269 | A | | 1/1997 | Youses et al. | 399/237 |
| 5,636,349 | A | | 6/1997 | Landa et al. | 399/307 |
| 5,669,045 | A | | 9/1997 | Swain | 399/159 |
| 5,704,291 | A | | 1/1998 | Lewis | 101/457 |
| 5,722,016 | A | | 2/1998 | Godlove et al. | 399/159 |
| 5,745,829 | A | | 4/1998 | Gazit et al. | 399/302 |
| 5,790,930 | A | | 8/1998 | Fuschiwald | 399/302 |
| 5,894,796 | A | | 4/1999 | Gelions | 101/219 |
| 5,946,525 | A | | 8/1999 | Okamura et al. | 399/66 |
| 6,044,243 | A | | 3/2000 | Hara | 399/302 |
| 6,075,965 | A | | 6/2000 | Tombs et al. | 399/308 |

FOREIGN PATENT DOCUMENTS

| | | | | | |
|---|---|---|---|---|---|
| EP | 0 590 924 | A1 | | 9/1993 | G03G/15/00 |
| EP | 0 928 999 | A2 | | 1/1999 | G03G/13/09 |
| JP | 59-168471 | A | * | 9/1984 | |
| JP | 63-296081 | A | * | 12/1988 | |
| JP | 3133695 | | | 6/1991 | B41N/10/02 |
| JP | 81996-114997 | | | 5/1996 | G03G/15/16 |
| JP | 2000235305 | | * | 8/2000 | |
| WO | WO 98/04961 | | | 2/1998 | G03G/15/16 |

* cited by examiner

*Primary Examiner*—Quana M. Grainger
(74) *Attorney, Agent, or Firm*—James D. Leimbach

(57) ABSTRACT

A deformable toner fuser roller, for use in a fusing station of an electrostatographic machine comprising a rigid cylindrical core member; an overdrive-controlling, elastically deformable structure surrounding the core member; and wherein the fuser roller is adapted to be heated by a heat source external to the roller and the overdrive-controlling elastically deformable structure comprises an effective or operational Poisson's ratio between 0.2 and 0.4.

18 Claims, 5 Drawing Sheets

EXTERNALLY HEATED DEFORMABLE FUSER ROLLER

CROSS REFERENCE TO RELATED APPLICATIONS

Reference is made to the commonly assigned U.S. patent applications, the disclosures of which are incorporated herein by reference.

- U.S. patent application Ser. No. 09/679,016, filed Oct. 4, 2000, in the names of Arun Chowdry et al, entitled DOUBLE-SLEEVED ELECTROSTATOGRAPHIC ROLLER AND METHOD OF USING.
- U.S. patent application Ser. No. 09/679,113, filed Oct. 4, 2000,in the names of Robert Charlebois et al, entitled INTERMEDIATE TRANSFER MEMBER HAVING A STIFFENING LAYER AND METHOD OF USING.
- U.S. patent application Ser. No. 09/679,177, filed Oct. 4, 2000,in the names of Muhammed Aslam et al, entitled SLEEVED ROLLERS FOR USE IN A FUSING STATION EMPLOYING AN INTERNALLY HEATED FUSER ROLLER.
- U.S. patent application Ser. No. 09/680,133, filed Oct. 4, 2000,in the names of Arun Chowdry et al, entitled SLEEVED PHOTOCONDUCTIVE MEMBER AND METHOD OF MAKING.
- U.S. patent application Ser. No. 09/680,134, filed Oct. 4, 2000,in the names of Muhammed Aslam et al, entitled SLEEVED ROLLERS FOR USE IN A FUSING STATION EMPLOYING AN EXTERNALLY HEATED FUSER ROLLER.
- U.S. patent application Ser. No. 09/680,135, filed Oct. 4, 2000,in the names of Jiann-Hsing Chen et al, entitled TONER FUSING STATION HAVING AN INTERNALLY HEATED FUSER ROLLER.
- U.S. patent application Ser. No. 09/680,136, filed Oct. 4, 2000,in the names of Arun Chowdry et al, entitled IMPROVED INTERMEDIATE TRANSFER MEMBER.
- U.S. patent application Ser. No. 09/680,139, filed Oct. 4, 2000,in the names of Robert Charlebois et al, entitled INTERMEDIATE TRANSFER MEMBER WITH A REPLACEABLE SLEEVE AND METHOD OF USING SAME.

FIELD OF THE INVENTION

This invention generally relates to fusing stations and rollers used within electrostatographic imaging and, more particularly, to an externally heated fusing roller having a deformable structure for controlling overdrive and improving image quality.

BACKGROUND OF THE INVENTION

In electrostatographic imaging and recording processes such as electrophotographic reproduction, an electrostatic latent image is formed on a primary image-forming member such as a photoconductive surface and is developed with a thermoplastic toner powder to form a toner image. The toner image is thereafter transferred to a receiver, e.g., a sheet of paper, and the toner image is subsequently fused to the receiver in a fusing station using heat or pressure, or both heat and pressure. The fuser member can be a roller, belt, or any surface having a suitable shape for fixing thermoplastic toner powder to the receiver. The fusing step in a roller fuser commonly consists of passing the toned receiver between a pair of rollers that are engaged to produce an area of contact pressure known as a fusing nip. In order to form the nip, at least one of the rollers typically has a compliant, or conformable, layer on its surface. Heat is transferred from at least one of the rollers to the toner in the fusing nip, causing the toner to partially melt and attach to the receiver. In the case where the fuser member is a heated roller, a resilient layer having a smooth surface is typically used which is bonded either directly or indirectly to the core of the roller. Where the fuser member is in the form of a belt (as described herein a belt refers to a flexible endless belt that passes around the heated roller) it typically has a smooth, hardened outer surface.

Most roller fusers are of a type known as simplex fusers that function to attach toner to only one side of the receiver at a time. In a simplex fuser, the roller that contacts the unfused toner is commonly known as the fuser roller and is usually heated. The roller that contacts the other side of the receiver is known as the pressure roller and is usually unheated. Either, or both, of the rollers can have a compliant layer on, or near, the surface. In most fusing stations employing a fuser roller and an engaged pressure roller, it is common for only one of the two rollers to be driven rotatably by an external source. The other roller is then driven rotatably by frictional contact.

Another less common roller fuser embodiment known within the prior art, is a duplex fusing station, which has two toner images that are simultaneously attached to each side of a receiver passing through a fusing nip. In such a duplex fusing station there is no real distinction between fuser roller and pressure roller with both rollers perform similar functions in providing heat and pressure.

Two basic types of simplex heated roller fusers have evolved. The first uses a deformable pressure roller to form the fusing nip against a hard fuser roller, such as in a Docutech 135 machine made by the Xerox® corporation. The second uses a deformable fuser roller to form the nip against a hard or relatively non-deformable pressure roller, such as in a Digimaster 9110 machine made by Heidelberg Digital LLC®. A deformable fuser roller as designated, herein, typically includes a conformable or a compliant layer having a thickness greater than about 2 mm and in some cases exceeding 25 mm. A hard fuser roller as designated herein, typically includes a rigid cylinder which can have a relatively thin polymeric, or conformable, elastomeric coating that is typically less than about 1.25 mm thick. A deformable fuser roller used in conjunction with a hard pressure roller tends to provide easier release of a receiver from the heated fuser roller, because the distorted shape of the deformable surface in the nip tends to bend the receiver towards the relatively non-deformable pressure roller and away from the much more deformable fuser roller.

Conventional toner fuser rollers typically have a cylindrical core member (which is often metallic such as aluminum) coated with one or more synthetic layers (which typically include polymeric materials made from elastomers).

The most common type of fuser roller is one that is internally heated, which means that a source of heat is provided inside the roller to generate the heat required for fusing. Such a fuser roller normally has a hollow core, inside of which is located a heating source, usually a lamp. Surrounding the core is an elastomeric layer through which heat is conducted from the core to the surface, and the elastomeric layer typically contains fillers for enhanced thermal conductivity.

Another type of fuser roller is referred to as an externally heated fuser roller is heated by surface contact between the fuser roller and one or more heating rollers. An example of an externally heated fuser roller is the Image Source 120 copier marketed by Eastman Kodak Company®. Externally heated fuser rollers are also disclosed by U.S. Pat. No. 5,450,183 issued to O'Leary and in U.S. Pat. No. 4,984,027 issued to Derimiggio et al.

A deformable fuser roller can include a compliant or conformable layer of any useful material, such as for example a substantially incompressible elastomer (those having a Poisson's ratio approaching 0.5). Such a substantially incompressible compliant layer including a poly (dimethyl siloxane) elastomer has been disclosed by Chen et al., in U.S. patent application Ser. No. 08/879,896 which is hereby incorporated by reference. Alternatively, a conformable layer can include a relatively compressible foam having a value of Poisson's ratio much lower than 0.5. A conformable polyimide foam layer is disclosed by Lee in U.S. Pat. No. 4,791,275. A lithographic printing blanket is disclosed by Goosen et al. in U.S. Pat. No. 3,983,287, illustrating a conformable layer containing a vast number of frangible, rigid-walled tiny bubbles which are mechanically ruptured to produce a closed cell foam having a smooth surface.

Receivers remove the majority of heat during fusing. Since receivers that have a narrower width than the fuser roller width, can have heat removed differentially, causing areas of higher temperature or lower temperature along the fuser roller surface parallel to the roller axis. Higher or lower temperatures can cause excessive toner offset in roller fusers.

Improved heat transfer to the surface of an externally heated fuser roller from external heating rollers will reduce the temperature of the external heating rollers as well as the mounting hardware and bearings attached to the external heating rollers.

A fuser module is disclosed in U.S. Pat. No. 6,016,409, issued to M. E. Beard et al., which includes an electronically readable memory that is permanently associated with the fuser module. This allows the control system of the printing apparatus to read codes from the electronically readable memory during installation to obtain parameters for operating the module, such as maximum web use, voltage and temperature requirements, and thermistor calibration parameters.

When a deformable roller is distorted to form a fusing nip, the thickness of the deformable material on the core is reduced inside the nip. When the deformable layer is substantially incompressible, the average speed of the portion of deformable layer within the fusing nip is inherently greater than parts of the deformable layer well away from the nip, because the volume flow rate of the elastomer is constant around the roller. This results in a surface speed of the deformable roller inside the nip which is different areas far away from the nip. For example, the deformable roller is a driving roller frictionally rotating a relatively non-conformable pressure roller, the pressure roller will rotate faster than if the fuser roller had been non-deformable, a phenomenon known as "overdrive". Overdrive can be expressed quantitatively, as a peripheral speed ratio, measured as the ratio of the peripheral surface speeds far away from the nip. A peripheral speed ratio of unity is equivalent to a condition of zero overdrive.

The speed ratio in a nip is determined principally by an effective Poisson's ratio of the roller materials, the moduli of the roller materials, the engagement of the rollers, and the drag torque forces of the rollers. The Poisson ratio of high polymers (a polymer with a high molecular weight) approaches 0.5, and approaches zero for very soft polymeric foams. It has been shown in theoretical model computations by K. D. Stack, Nonlinear Finite Element Model of Axial Variation in Nip Mechanics with Application to Conical Rollers [Ph.D. Thesis, University of Rochester, Rochester, N.Y. (1995), FIGS. 5–6 and 5–7, pages 81 and 83] that for a special case of a rigid cylindrical roller coated by a layer of deformable material frictionally driving, with no drag, a nondeformable moving planar element, the deformable material should have a value of Poisson's ratio of about 0.3 in order to have negligible overdrive, i.e., a speed ratio which is substantially equal to unity. For values of Poisson's ratio larger than about 0.3, the surface of the roller (distorted by the nip) is stretched in the nip zone, producing overdrive of the planar element with respect to the roller. For values of Poisson's ratio smaller than about 0.3, the surface of the roller is compressed inside the nip zone, producing underdrive of the planar element with respect to the roller, i.e., the surface speed is smaller than the peripheral speed of the roller far away from the nip.

A foam or sponge can include a "felted" material, as is well known in the art. Felted foams can be made, for example, by compressing under heat, typically uniaxially, an elastomeric, previously made foam, followed by cooling it under compression and then removing the compressive load. Felted foams have anisotropic mechanical properties such that the Young's modulus and Poisson's ratio can be different in different directions. For example, both the Young's modulus and Poisson's ratio of a felted foam material made by uniaxial compression will be different along the direction of compression that lies in a plane at right angles to the direction of compression. Moreover, Poisson's ratio, which tends to be small for soft foams, can even take on negative values in felted foams or sponges.

A deformable roller including a substantially incompressible elastomer that is displaced by distortion in a fusing nip with another roller results in an extra thickness of the deformable layer adjacent to either side of the fusing nip, i.e., pre-nip and post-nip bulges. The highest pressure in the nip will be obtained near the center of the nip (at the intersection of the joined surfaces and an imaginary line between the centers of the two rollers). Since one roller drives the other, the surface velocities of the rollers should be close to equal at the point of maximum pressure, near the center of the nip. As previously explained, the surface velocities in the pre-nip and post-nip bulges will generally be different. In view of these facts, it can be understood that in general there will be locations in the contact zone of the nip where the surface velocities of the two rollers differ, i.e., there will be slippage. This slippage, which can be substantial just after entry and just before exit of the nip, is a cause of wear which shortens roller life.

A potentially serious problem for fusing arising from the presence of overdrive is "differential overdrive", associated for example with tolerance errors in mounting the rollers forming the fusing nip, or with roller runout which can be caused by variations of roller concentricity or eccentricity. Runout can have many causes, e.g., fluctuations in layer thicknesses along the length of a roller, variations in the dimensions of a core member, an acentric roller axis, and so forth. It will be evident that differential overdrive can result in localized differential slippages along the length of a fusing nip, inasmuch as the local effective speed ratio would otherwise tend to fluctuate or change with time along the length of the nip, causing some portions of the driven roller to try to lag and other portions to try to move faster than the average driven speed. Differential overdrive can have serious consequences for fusing, including the formation of large scale image defects and wrinkling of a receiver.

All rollers suffer from surface wear, especially where the edges of receivers contact the rollers. Since relative motion due to slippage between rollers increases wear, the changes in velocity of the surface of a deformable roller, as it travels into, through, and out of a fusing nip formed with a relatively non-deformable roller, should increase the wear rate of the deformable roller, especially if the deformable roller is the heated fusing member, bearing in mind that a fuser roller typically faces a relatively rough and abrasive paper surface in the nip. Moreover, since the material on a deformable roller is stretched and relaxed each time it passes through the fusing nip, this flexure can result in fatigue aging and wear, including failure of the roller due to splitting or cracking of the deformable material, or even delamination.

To obtain high quality electrophotographic copier/printer image quality, image defects must be minimized. One type of defect is produced by smearing of image dots or other small-scale image features in the fusing nip. Relative motions associated with overdrive and resulting in localized slippage between rollers in a fusing nip can cause softened toner particles to smear parallel to the direction of motion, resulting for example in elongated dots.

Some roller fusers rely on film splitting of low viscosity oil to enable release of the toner and (hence) receiver from the fuser roller. Relative motion in the fusing nip can disadvantageously disrupt the oil film.

An externally heated toner fuser roller commonly includes a hollow cylindrical core, often metallic. A resilient conformable cushion layer, which can contain filler particles to improve mechanical strength and/or thermal conductivity, is typically formed on the surface of the core, which can advantageously be coated with a primer to improve adhesion of the resilient layer. Roller cushion layers are commonly made of silicone rubbers or silicone polymers such as, for example, poly(dimethylsiloxane) (PDMS) polymers of low surface energy, which minimize adherence of toner to the roller.

Frequently, release oils composed of, for example, poly (dimethyl-siloxanes) are also applied to the fuser roller surface to prevent the toner from adhering to the roller. Such release oils (commonly referred to as fuser oils) can interact with the PDMS in the resilient layer upon repeated use, which in time causes swelling, softening, and degradation of the roller. A thin barrier layer, for example a cured polyfluorocarbon, can be formed on the cushion layer to prevent these deleterious effects caused by release oil.

Electrophotography can be used to create high quality multicolor toner images when the toner particles are small, that is, diameters less than about 10 micrometers, and the receivers, typically papers, are smooth. A typical method of making a multicolor toner image involves trichromatic color synthesis by subtractive color formation. In such synthesis, successive imagewise electrostatic images, each representing a different color, are formed on a photoconductive element, and each image is developed with a toner of a different color. Typically, the colors correspond to each of the three subtractive primary colors (cyan, magenta and yellow) and, optionally, black. The imagewise electrostatic images for each of the colors can be made successively on the photoconductive element by using filters to produce color separations corresponding to the colors in the image. Following development of the color separations, each developed separation image can be transferred from the photoconductive element successively in registration with the other color toner images to an intermediate transfer member. All the color toner images can then be transferred in one step from the intermediate transfer member to a receiver, where they are fixed or fused to produce a multicolor permanent image. Alternatively, an electrophotographic apparatus including a series of tandem modules can be employed, such as disclosed in U.S. patent application Ser. No. 09/199,896, filed in the names of Herrick et al., wherein color separation images are formed in each of four color modules and transferred in register to a receiver member as the receiver member is moved through the apparatus while supported on a transport web.

To rival the photographic quality produced using silver halide technology, it is desirable that these multicolor toner images have high gloss. To this end, it is desirable to provide a very smooth fusing member contacting the toner particles in the fusing station.

In the fusing of the toner image to the receiver, the area of contact of a deformable fuser roller with the toner-bearing surface of a receiver sheet as it passes through the fusing nip is determined by the amount of pressure exerted by the pressure roller and by the characteristics of the deformable material. The extent of the contact area helps establish the length of time that any given portion of the toner image will be in contact with and heated by the fuser roller.

Filler particles can be included in a barrier layer. For example, Chen et al. U.S. Pat. No. 5,464,698, the disclosure of which is incorporated herein by reference, describes a toner fuser member having a silicone rubber cushion layer and an overlying layer of a cured fluorocarbon polymer in which is dispersed a filler including a particulate mixture that includes tin oxide.

Chen et al., in U.S. patent application Ser. No. 08/879,896 disclose an improved fuser roller including three concentric layers each including a particulate filler, i.e., a base cushion layer including a condensation-cured PDMS, a barrier layer covering the base cushion and includes a cured fluorocarbon polymer, and an outer surface layer including an addition-cured PDMS, the particulate fillers in each layer including one or more of aluminum oxide, iron oxide, calcium oxide, magnesium oxide, tin oxide, and zinc oxide. The barrier layer, which can include a Viton™ elastomer (sold by DuPont) or a Fluorel™ elastomer (sold by Minnesota Mining and Manufacturing), is a relatively low modulus material typically having a Young's modulus less than about 10 MPa, and it therefore has a negligible effect upon the mechanical characteristics of the roller, including overdrive.

To reduce wear and aging and thereby prolong the life of an externally-heated fuser roller for use in electrostatography, there remains a need for a reduced or negligible propensity to exhibit overdrive behavior when the fuser roller is engaged in a fusing nip with a pressure roller. To improve image quality, there remains a further need for an externally-heated fuser roller that has a negligible propensity to produce overdrive-induced image defects, either largescale or small-scale, when used with a pressure roller.

SUMMARY OF THE INVENTION

The present invention addresses the above discussed shortcomings within the prior art by providing an eternally-heated toner fusing roller which includes a deformable structure having an effective or operational Poisson's ratio within a predetermined range. The invention provides an externally heated deformable multilayer fuser roller for improved fusing of toner images in an electrostatographic machine. The individual layers of a preferred fuser roller have Poisson's ratios and Young's moduli chosen in preselected ranges, to minimize overdrive and also to minimize differential overdrive in a fusing station. Because of reduced overdrive, a roller of the invention wears slowly and has a long operational life. Moreover, because of reduced differential overdrive, image quality is improved and paper wrinkling is reduced. An overdrive-controlling externally heated fuser roller of the invention can be used in simplex and duplex fusing stations.

In accordance with the invention there is provided a deformable toner fuser roller, for use in a fusing station of an electrostatographic machine including a deformable toner fuser roller for use in a fusing station of an electrostatographic machine, comprising a rigid cylindrical core member; a replaceable removable sleeve member surrounding and in intimate nonadhesive contact with the core member; and wherein the fuser roller is adapted to be heated by a heat source external to the roller.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus can be modified. For clarity of understanding of the drawings, relative proportions depicted or indicated of the various elements of which disclosed members are included are not be representative of the actual proportions, and some of the dimensions have been selectively exaggerated.

FIG. 2(*b*) depicts a cross-sectional view of a preferred externally-heated fuser roller which includes a sleeve member including a deformable structure surrounding a rigid core member in accordance with a third embodiment of the invention.

FIG. 2(*c*) depicts a cross-sectional view of an externally-heated fuser roller which includes a deformable structure having a stiffening layer, the deformable structure surrounding a rigid core member in accordance with a fourth embodiment of the invention.

FIG. 2(*d*) depicts a cross-sectional view of a preferred externally-heated fuser roller which includes a sleeve member including a deformable structure having a stiffening layer, the sleeve member surrounding a rigid core member in accordance with a fifth embodiment of the invention.

DETAILED DESCRIPTION OF THE PREFERRED EMBODIMENTS

Figure 1:
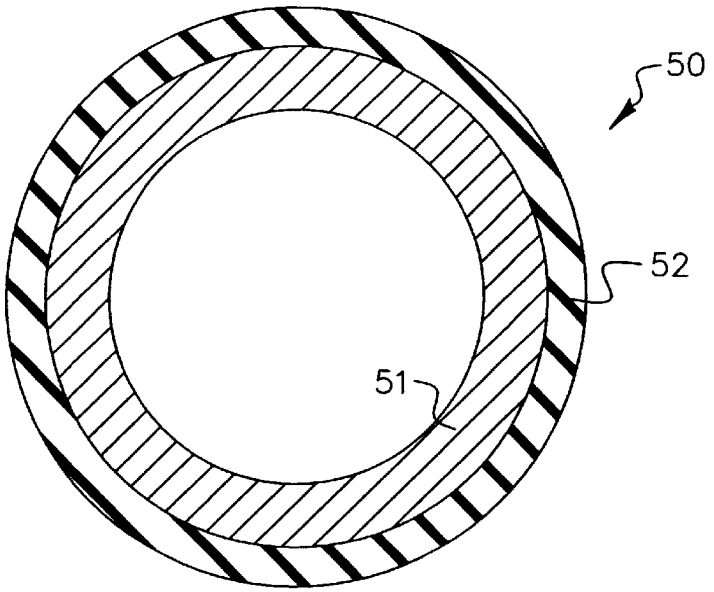
FIG. 1 depicts a cross-sectional view of an externally-heated fuser roller which includes a deformable structure surrounding a rigid core member in accordance with a first embodiment of the invention.
Figure 2A:
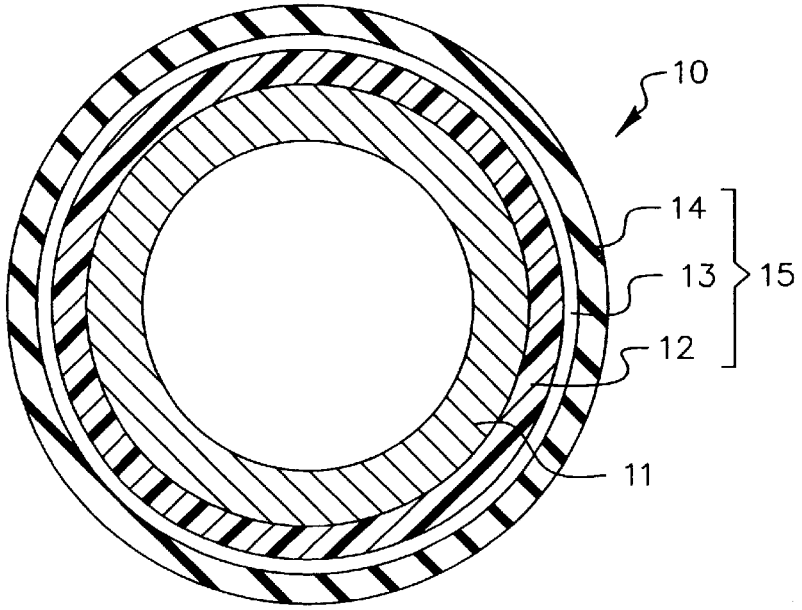
FIG. 2(*a*) depicts a cross-sectional view of an externally-heated fuser roller which includes a deformable structure surrounding a rigid core member in accordance with a second embodiment of the invention.
Figure 2B:
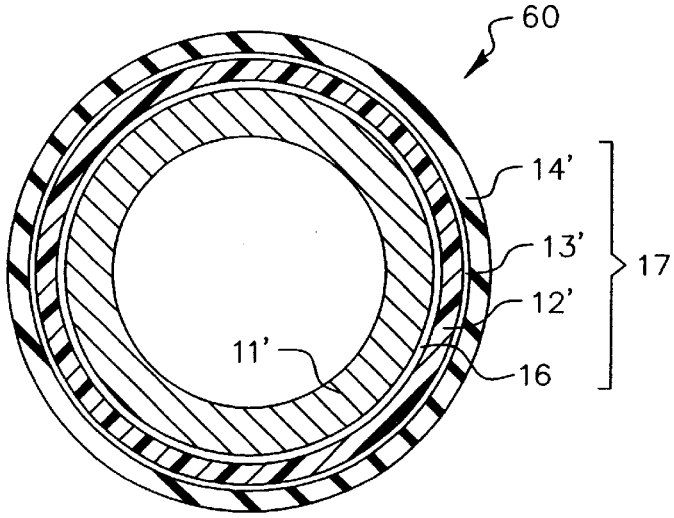
Figure 2C:
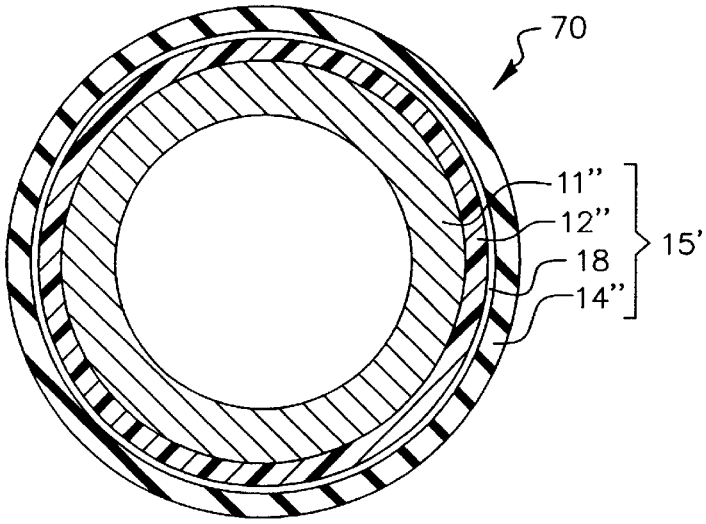
Figure 2D:
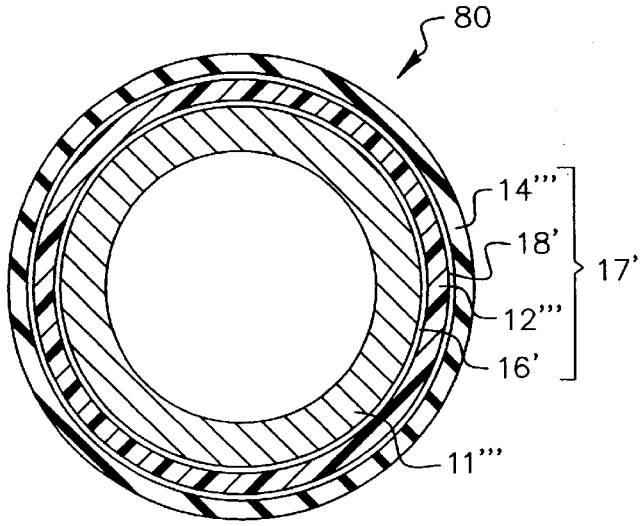

The invention relates to electrostatographic reproduction utilizing a fusing station and fuser members therein to thermally fuse an unfused toner image to a receiver, e.g., paper, including coated papers, or plastic such as transparencies. A fuser member can be a roller, belt, or any surface having a suitable shape for fixing thermoplastic toner powder to the receiver. The fusing station preferably includes two rollers which are engaged to form a fusing nip in which an externally heated fuser roller comes into direct contact with the unfused toner image as the receiver is frictionally moved through the nip. The externally heated roller is heated by a heat source which preferably includes one or more heating rollers in contact with it. Alternatively, the heat source can be external radiation absorbed by the fuser roller, e.g., as provided by one or more lamps, or any other suitable heating source that is external to the fuser roller. The receiver can consist of a cut sheet or it can be a continuous web. The unfused toner image can include a single-color toner or it can include a composite image of two or more single-color toners, e.g., accent color or a full process color composite image made for example from black, cyan, magenta, and yellow toners. The unfused toner image on the receiver is previously transferred, e.g., electrostatically, to the receiver from a toner image bearing member such as a primary image-forming member or an intermediate transfer member. The electrostatographic reproduction can utilize a photoconductive electrophotographic primary image-forming member or a non-photoconductive electrographic primary image-forming member. Particulate dry or liquid toners can be used.

A fuser member of the invention is an externally heated deformable roller including an overdrive-controlling, deformable structure which can include one or more concentric layers surrounding a core member. Deformable fuser rollers, well known in the prior art, generally exhibit undesirable amounts of overdrive resulting in premature wear and reduced life, and also have a propensity for producing differential overdrive resulting in image defects. To overcome these problems, the overdrive-controlling deformable structure of an inventive roller has Poisson's ratios and Young's moduli chosen in preselected ranges.

A simplex fusing station of the invention can include several embodiments. In the most preferred embodiment of a fusing station, a novel externally heated fuser roller which includes an overdrive-controlling, elastically deformable structure is engaged in a fusing nip with a hard pressure roller. In this preferred embodiment, a distorted shape of the deformable fuser roller in the nip helps to release the receiver from the fuser roller and tends to guide it more towards the hard pressure roller as the receiver passes out of the nip, thereby helping to avert, for example, paper jams. A deformable externally heated inventive fuser roller can also be engaged in a fusing nip with a compliant pressure roller which includes an overdrive-controlling, deformable structure, but in general this is less preferred because of the increased cost. A simplex fusing station of the invention can be used to fuse an unfused toner image to one side of a receiver which already has a previously fused toner image on the reverse side.

A preferred duplex fusing station of the invention includes a deformable externally heated first fuser roller which includes an overdrive-controlling, elastically deformable structure, engaged in a fusing nip with an externally heated second fuser roller which includes an overdrive-controlling, elastically deformable structure. The duplex fusing station simultaneously fuses two unfused toner images, one on the front and one on the back of the receiver.

Although not explicitly disclosed in the preferred embodiments, it will be understood that an optional supplementary source of heat for fusing, either external or internal, can be provided to any roller included in a fusing station of the invention.

Referring to the accompanying drawings, FIG. 1 shows a cross-sectional view of a first embodiment of an inventive fuser roller, indicated as 50 and including a rigid cylindrical core member 51, with an overdrive-controlling, elastically deformable structure 52 adhered to and surrounding the core 51.

Core member 51 is preferably tubular and preferably includes a metal such as, for example, aluminum or other suitable metal, and can include internal strengthening members such as struts and the like. Other materials besides metal or metal composites can also be used.

The overdrive-controlling elastically-deformable structure 52 preferably has an effective or operational Poisson's ratio less than about 0.35, and more preferably between about 0.25 and 0.35, and most preferably between 0.25 and 0.29. In order to achieve such low values of Poisson's ratio, one layer at least of the elastically deformable structure 52 is generally a foam, or it can include individual compressible elements such as for example gas-filled bubbles embedded in an elastic matrix. Poisson's ratio of a material can be readily measured in a macroscopic-size piece by applying a compressive stress along one direction of a bar shaped sample of the material, e.g., the z-axis in a Cartesian coordinate system, measuring a corresponding transverse strain parallel to the x-axis (or y-axis), and dividing the x-axis strain by the z-axis strain. In an isotropic foam or sponge material, the x- and y-strains will be identical, but for felted foams, for example, this will generally not be the case. Moreover, an operational or effective value of Poisson's ratio of a compound roller including different layers, one of which is a foam, can also be readily measured using the same technique.

The elastically-deformable structure 52, which can include one or more layers, is preferably between about 2 mm and 25 mm thick, and more preferably about 4 mm to 12 mm thick.

When the elastically-deformable structure 52 has more than one layer, the least stiff layer of is preferably a foam or a sponge layer, which can include an open-cell or closed-cell foam, including felted foams. The least stiff layer can also have elastomeric particles or ground up pieces, which have been fused or sintered into a porous mass. The Young's modulus of an elastically-deformable foam is typically much less than that of its solid phase. A typical foam or sponge can have a Young's modulus which is an order of magnitude smaller than that of the solid phase. Young's modulus of a foam (or the effective or operational Young's modulus of any material, including a laminated or layered material) is determined on a macroscopic-size sample using a standard technique, such as by measuring the strain of the sample along a given direction under an applied stress using a suitable commercial device such as an Instron Tensile Tester and extrapolating the slope of the curve back to zero applied stress. It is preferred that the effective or operational Young's modulus of the deformable structure 52 is typically in a range of about 0.05 to 50 MPa, preferably about 0.1 to 10 MPa.

The thermal conductivity in a radial direction of deformable structure 52 is preferred to be less than about 0.5 BTU/hr/ft/° F. within the nip zone.

In order to tailor or control the mechanical properties of the elastically-deformable structure 52, it can also include one or more of the following: a particulate filler, a composite material, or a polyphase material including a foam.

The roller 50 can also include a replaceable removable sleeve member. The sleeve member includes a supporting or strengthening band (not shown) which is in intimate non-adhesive contact and snugly surrounds core member 51, with the overdrive-controlling conformable structure uniformly adhered to the strengthening band. The sleeve can be mounted on, or removed from, the core 51 by means of a compressed air technique as disclosed in the art. The sleeve can also be mounted or removed by cooling the core member to shrink it (or warming the sleeve to expand it) and sliding the sleeve along the core member. The strengthening band can be rigid, but is preferred to be flexible. The strengthening band preferably has a Young's modulus in a range of about 100–300 GPa, and a thickness preferably in a range of about 20–500 micrometers, more preferably about 40–100 micrometers. The strengthening band, which can be fabricated from a sheet, for example by ultrasonic welding or by an adhesive, can also include any suitable material such as metal, elastomer, plastic or a reinforced material such as, for example, a reinforced silicone belt. It is preferred that the strengthening band be in the form of a seamless web or tube including nickel or steel.

FIG. 2(*a*) shows a cross-sectional view, not to scale, of a second embodiment of an inventive fuser roller, indicated by the numeral 10. Roller 10 includes a rigid cylindrical core member 11, similar in all respects to core member 51 of roller 50 shown in FIG. 1, and an overdrive-controlling elastically deformable structure 15 surrounding the core. Structure 15 includes an elastically conformable base cushion layer 12 formed on core 11, and an elastically compliant toner release layer 14 adhered to the conformable base cushion layer. An optional thin flexible barrier layer 13 can be interposed between, and adhered to, layers 12 and 14. In this second embodiment, the conformable base cushion layer 12 is adhered to the core 11.

The core member 11 is preferably in the form of a cylindrical tube made from any suitable material, e.g., aluminum. The core member can have internal reinforcing members, e.g., struts, or other internal strengthening structures (not shown). To promote adhesion between the core 11 and the base cushion layer (BCL) 12, a thin primer layer (not shown in FIG. 1) can be used, such as for example made from air-dried GE 4044 priming agent (sold by General Electric Company, Schenectady, New York). The toner release layer (TRL) 14 and the BCL 12 can include the same or different materials.

The BCL 12 can include any suitable thermally stable elastomeric material, and in particular can include more than one phase, e.g., a two-phase material such as a foam or sponge layer, which can have an open-cell or closed-cell foam, including felted foams. The BCL 12 can also include elastomeric particles or ground up pieces which have been fused or sintered into a porous mass. Alternatively, the BCL 12 could also include individual compressible elements, such as for example a plethora of gas-filled spheres or walled bubbles embedded in an elastic matrix. Preferably, the BCL 12 includes a conformable material, e.g., a foam, having a Poisson's ratio which is less than about 0.35, more preferably between about 0.25 and 0.35, and most preferably between about 0.25 and 0.29. It is preferred that a BCL 12 including a foam is relatively stiff, i.e., having a Young's modulus preferably in a range of about 0.05 MPa to 50 MPa, and more preferably about 0.1 MPa to 10 MPa. The solid phase of a BCL 12 including a foam preferably has an open-cell or closed-cell structure having a Young's modulus in a range of about 0.5 MPa to 500 MPa, and more preferably, about 1 MPa to 100 MPa. The solid phase of a BCL 12 including a foam can be a fluoroelastomer, e.g., a Viton™ (from DuPont) or a Fluorel™ (from Minnesota Mining and Manufacturing). Alternatively, the BCL 12 can include a rubber, such as an EPDM rubber made from ethylene propylene diene monomers, which can further include a metal oxide particulate filler, e.g., iron oxide. As another alternative, the BCL 12 can also include a poly (dimethylsiloxane) elastomer further including a metal oxide particulate filler, e.g., aluminum oxide, iron oxide, calcium oxide, magnesium oxide, nickel oxide, tin oxide, zinc oxide, or mixtures thereof. The BCL 12 could also include a polyimide foam which could further have a filler. A filler embedded in the solid phase of a BCL 12 preferably includes particles having a mean diameter between about 0.1 micrometer and 100 micrometers and about 3 to 30 volume percent of the solid phase of the base cushion layer, and more preferably, a mean diameter between about 0.5 micrometer and 40 micrometers and about 5 to 20 volume percent of the solid phase of the base cushion layer. The base cushion layer 12 preferably has a thickness between about 0.5 mm and 25 mm, and more preferably between about 1.25 mm and 12.5 mm. The BCL 12 preferably has a thermal conductivity in a radial direction less than about 0.4 BTU/hr/ft/° F. within the nip zone, and more preferably in a range of about 0.1–0.3 BTU/hr/ft/° F. in a radial direction within the nip zone.

The outer compliant layer or compliant toner release layer (TRL) 14 preferably has a highly smooth outermost surface. The TRL is preferred to be highly resistant to abrasion, and can include any suitable elastomeric material preferably having a low surface energy, such as for example a silicone rubber, or a fluoroelastomer. The TRL can include for example a PDMS, preferably an addition-cured poly (dimethylsiloxane) elastomer and silica and titania fillers. A toner release layer 14 providing suitable smoothness, of which the composition and coating method are disclosed by Chen et al. in U.S. application Ser. No. 08/879,896, can include Silastic™ E RTV silicone rubber available from Dow Coming Corporation. The compliant toner release layer 14 has a thickness preferably in a range about 0.25 mm to 5 mm, and more preferably in a range between about 1 mm to 5 mm. The TRL preferably has a thermal conductivity in a range of about 0.2–0.5 BTU/hr/ft/° F., and a Young's modulus between about 0.05 MPa and 50 MPa, more preferably about 0.1 MPa–10 MPa The Poisson's ratio of the TRL is preferably between about 0.45 and 0.50. It is preferred that the TRL be substantially incompressible, with a more preferred Poisson's ratio between about 0.48 and 0.50 (the upper limit being a rounded off number). The compliant toner release layer 14 further includes a particulate filler which can be aluminum oxide, iron oxide, calcium oxide, magnesium oxide, nickel oxide, tin oxide, zinc oxide, copper oxide, titanium oxide, silicon oxide, graphite, and mixtures thereof, and preferably zinc oxide. The particulate filler preferably includes about 5 to 50 volume percent of said toner release layer, and more preferably, about 10 to 35 volume percent. Preferably, the filler helps to provide good thermal conductivity in the TRL, which reduces variations in temperature near the surface of the roller and thereby improves fusing uniformity and image quality.

Preferably, the conformable base cushion layer 12 has a Young's modulus which is of the same order of magnitude as the Young's modulus of the compliant toner release layer 14.

The optional thin barrier layer 13 could be required to prevent fuser oil from penetrating into and damaging the base cushion layer 12. The barrier layer 13 preferably includes a fluoropolymer and about 20 to 40 volume percent of a particulate filler. The fluoropolymer is preferably a random copolymer formed from mixtures of monomer units selected from vinylidene fluoride, tetrafluoroethylene, and hexafluoropropylene. The filler can be aluminum oxide, iron oxide, calcium oxide, magnesium oxide, nickel oxide, tin oxide, and mixtures thereof. Preferably the optional barrier layer has a thickness in a range of about 10 micrometers to 50 micrometers.

FIG. 2(*b*) shows a cross-sectional view of a preferred third embodiment of the invention, indicated by 60. The primed entities 11', 12', 13' and 14' correspond in all respects of dimensions, materials and physical properties to the unprimed entities of FIG. 2(*a*), namely, core member 11, base cushion layer 12, barrier layer 13, and toner release layer 14, respectively. The roller 60 includes a replaceable removable sleeve member 17 which includes a strengthening band 16, base cushion layer 12' formed on the strengthening band, an optional barrier layer 13' adhered to the base cushion layer, and a toner release layer 14' adhered to the barrier layer. The sleeve member 17 preferably has a form of a tubular belt, and is in intimate nonadhesive contact and snugly surrounds core member 11', with the conformable base cushion layer 12' uniformly adhered to the strengthening band 16. The strengthening band, which can be fabricated from a sheet, for example by ultrasonic welding or by an adhesive, can also include of any suitable material, including metal, elastomer, plastic or a reinforced material such as, for example, a reinforced silicone belt. It is preferred that the strengthening band be in the form of a seamless web or tube including nickel or steel, preferably an electroformed belt made of nickel available from Stork Screens America, Inc., of Charlotte, N.C. The sleeve can be mounted on, or removed from, the core 11' by means of any conventional compressed air technique. The strengthening band of an unmounted sleeve preferably has an inner diameter that is a little smaller than the outside diameter of the core, typically about 300 micrometers smaller, providing an interference fit. In order to mount the sleeve on the core, the compressed air assist technique is used to elastically stretch the tubular sleeve slightly so that it can be slid into place on the core member. In order to aid sliding, a lubricating aid can be applied to either the outer surface of the core or to the inner surface of the strengthening band. Lubricating aids include materials which produce a low-surface-energy sliding interface, such as sub-micron particles of silica, zinc stearate, or other suitable materials. After the sleeve is suitably positioned on the core, and the compressed air turned off, the stretched sleeve relaxes and grips the core member snugly. The sleeve could alternatively be mounted or removed by cooling the core member to shrink it (or warming the sleeve to expand it) and sliding the sleeve along the core member. The strengthening band 16 can be rigid, but is preferred to be flexible. The strengthening band preferably has a Young's modulus in a range of about 100 GPa–300 GPa, and a thickness preferably in a range of about 20 micrometers–500 micrometers, more preferably about 40 micrometers–100 micrometers.

FIG. 2(*c*) shows a cross-sectional view of a preferred fourth embodiment of the invention, indicated by 70. The doubly-primed entities 11", 12", and 14" correspond in all respects of dimensions, materials and physical properties to the unprimed entities of FIG. 2 (*a*), namely, core member 11, base cushion layer 12, and toner release layer 14, respectively. Roller 70 includes a core member 11" and an overdrive-controlling elastically deformable structure 15' surrounding the core. Elastically deformable structure 15' includes a base cushion layer 12" formed on the core member 11", a stiffening layer 18 surrounding and in intimate contact with the base cushion layer, and a toner release layer 14" formed on the stiffening layer. The stiffening layer 18 also functions as a barrier layer to prevent fuser oil from penetrating to the base cushion layer. The stiffening layer 18 is preferably thermally conductive, thin, and flexible, and has the form of a tubular belt. Stiffening layer 18 is preferably seamless. Layer 18 can include any suitable material, including polymers and reinforcing members such as fibers or woven materials. Preferably, layer 18 is a thin metallic band including any suitably strong metal including plated metals, such as for example nickel or stainless steel. Layer 18 has a thickness less than about 500 micrometers, preferably in a range of about 10–200 micrometers, and a Young's modulus greater than about 0.1 GPa, preferably in a range of about 50–300 GPa. The preferred material for layer 18 is nickel in the form of an electroformed belt available, e.g., from Stork Screens America, Inc., of Charlotte, N.C. The roller 70 can be manufactured by forming the base cushion layer on the core member, e.g., in a mold, and then cooling the core plus base cushion layer in order to shrink it, e.g., by using dry ice, followed by sliding the stiffening layer, e.g., in the form of a seamless metallic belt, on to the base cushion layer. After warming, e.g., to room temperature, the toner release layer is formed on the stiffening layer, e.g., by solvent coating and curing.

FIG. 2(*d*) shows a cross-sectional view of a preferred fifth embodiment of the invention, indicated by 80. The triply-primed entities 11'", 12", and 14"'correspond in all respects of dimensions, materials and physical properties to the unprimed entities of FIG. 2(*a*), namely, core member 11, base cushion layer 12, and toner release layer 14, respectively. The roller 80 includes a replaceable removable sleeve member 17'which includes a strengthening band 16', a base cushion layer 12'" formed on the strengthening band", a stiffening layer 18' surrounding and in intimate contact with the base cushion layer, and a toner release layer 14'" formed on the stiffening layer. The sleeve member 17' preferably has a form of a tubular belt, and is in intimate nonadhesive contact and snugly surrounds core member 11'", with the conformable base cushion layer 12'" uniformly adhered to the strengthening band 16'. The stiffening layer 18' corresponds in all respects of dimensions, materials and physical properties to layer 18 of FIG. 2(*c*), and the strengthening band 16' corresponds in all respects of dimensions, materials and physical properties to strengthening band 16 of FIG. 2(*b*). The roller 80 can be manufactured by first mounting the strengthening band on a mandrel, e.g., by using the compressed air assist technique described above, forming the base cushion layer on the strengthening band, e.g., in a mold, and then cooling the assembled mandrel with the strengthening band plus base cushion layer in order to shrink the assembly, e.g., by using dry ice, followed by sliding the stiffening layer, e.g., in the form of a seamless metallic belt, on to the base cushion layer. After warming, e.g., to room temperature, the toner release layer is formed on the stiffening layer, e.g., by solvent coating and curing, whereupon the finished sleeve member can be removed from the mandrel by using the compressed air assist technique, and the sleeve member subsequently mounted on the core member, e.g., by using the compressed air assist technique or the cooling technique, to provide a finished fuser roller.

In addition to the layers already described for rollers 10, 50, 60, 70, and 80, thin subbing layers or adhesive layers can be provided between any of the adherent or adjoining interfaces in order to promote the coating of layers, the bonding between layers, or the shear strength at the interfaces between layers.

Figure 3:
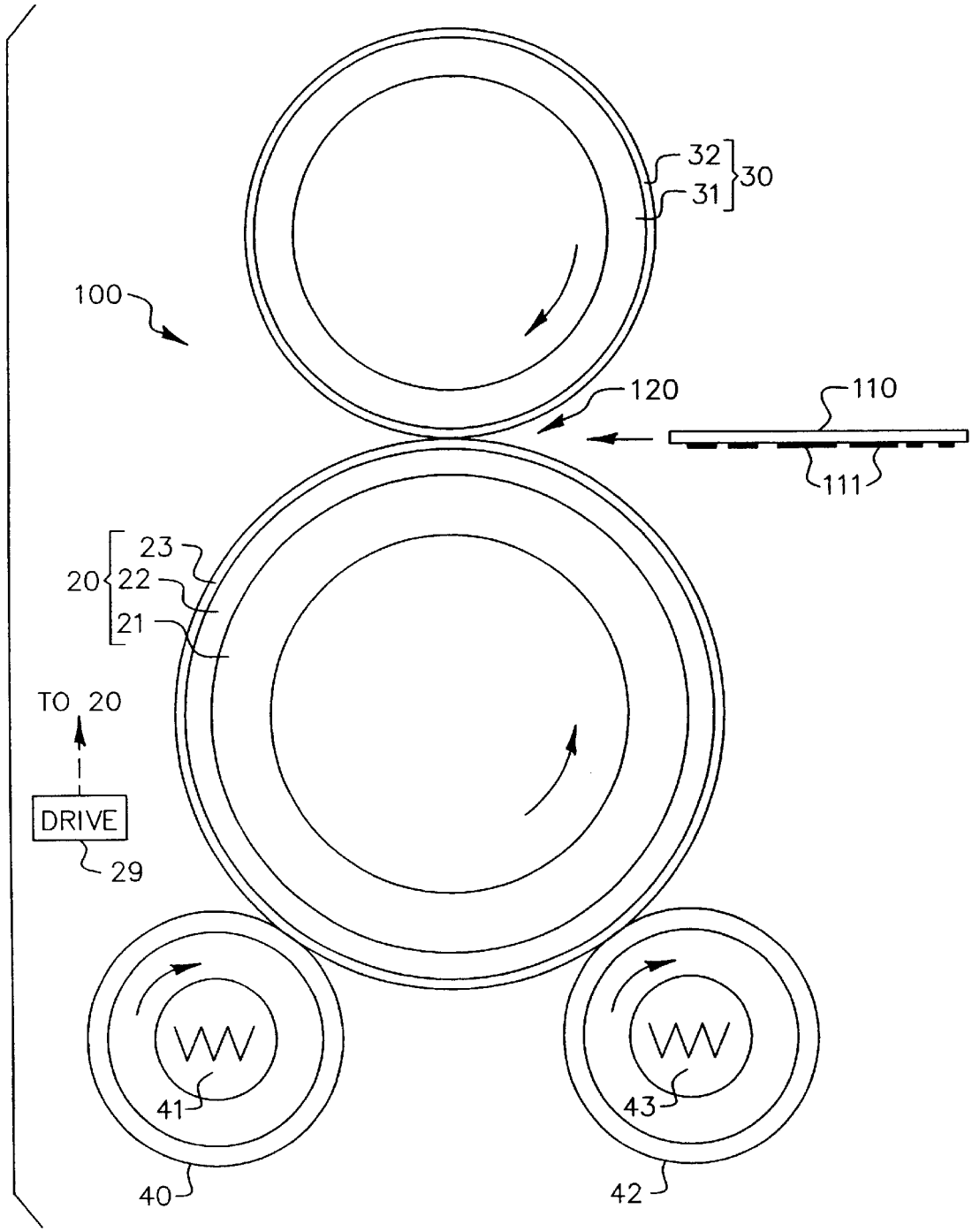
FIG. 3 depicts an end view of a simplex toner fusing station which includes a hard pressure roller engaged in a fusing nip with a preferred externally-heated fuser roller in accordance with the invention.

FIG. 3 shows a preferred embodiment of an inventive simplex fuser station, designated by the numeral 100. A rotating fuser roller 20 moving in the direction indicated by an arrow includes a cylindrical core 21, a conformable base cushion layer (BCL) 22 surrounding the core, and a compliant toner release layer (TRL) or outer layer 23 adhered to the base cushion layer. An optional barrier layer (not shown) having dimensions and properties similar to those of layers 13 and 13' in FIGS. 2(*a*) and 2(*b*) can be interposed between layers 22 and 23. BCL 22 has preferred ranges of dimensions and characteristics which are the same as those of the conformable layer 12 of FIG. 2. Similarly, TRL 23 has preferred ranges of dimensions and characteristics which are the same as those of the compliant toner release layer 14 of FIG. 2. In another preferred embodiment of a simplex fusing station (not illustrated), roller 20 is replaced by a roller that has a structure and preferred ranges of dimensions and characteristics which are the same as those of roller 50 of FIG. 1. The surface of roller 20 is externally heated by a heat source in the form of contacting counter-rotating cylindrical heating rollers 40 and 42 rotating in the direction of the indicated arrows and including corresponding interior heating elements 41 and 43. Alternatively, the external heat source could be absorbed by the fuser roller via radiation, e.g., as provided by one or more radiation sources, or by any other suitable external heating source. A counter-rotating hard pressure roller 30 moving in the direction of an indicated arrow forms a fusing nip 120 with compliant fuser roller 20. A receiver sheet 110 carrying an unfused toner image 111 facing the fuser roller 20 is shown approaching nip 120. The receiver sheet is fed into the nip by employing well known mechanical means (not shown) such as a set of rollers or other means such as a moving web. The fusing station preferably has one driving roller, the other rollers being driven and rotated frictionally by contact with the driving roller. For instance, the driving roller could be fuser roller 20, with rollers 30, 40 and 42 being driven rollers. A suitable drive source 29 such as a motor and mechanical coupling is connected to roller 20 to drive same. When the receiver sheet exits the fusing nip the toner image is fused to the receiver sheet.

Although two heating rollers 40 and 42 are shown in FIG. 3, one or more heating rollers can be used. A heating roller is made from any suitable thermally conductive rigid material, preferably aluminum, and can further include a preferably thermally stable low surface energy thin polymeric coating on its surface, e.g., a fluoroelastomer or a silicone rubber, typically less than about 1.25 mm thick (not identified in FIG. 3). A tubular heating roller is preferred. A heating element in the interior of a tubular heating roller can include an axially centered tubular incandescent heating lamp, e.g. lamps 41 and 43, or an ohmically heated resistive filament, or other suitable interior source of heat. Preferably, the heat source is controlled by a feedback circuit, for example by utilizing a thermocouple to monitor and thereby control the surface temperature of fuser roller 20 by employing a programmable voltage power supply (not shown) to regulate the temperature of the lamps 41 and 43.

The pressure roller 30 includes a core member 31 and an optional surface layer 32 coated on the core. The core can be made of any suitable rigid material, e.g., aluminum, preferably including a cylindrical tube. Optional surface layer 32 is preferred to be less than about 1.25 mm thick and preferably includes a thermally stable preferably low-surface-energy compliant or conformable material, for example a silicone rubber, e.g., a PDMS, or a fluoroelastomer such as a Viton™ (from DuPont) or a Fluorel™ (from Minnesota Mining and Manufacturing). Alternatively, layer 32 can include a relatively hard poly(tetrafluoroethylene) or other suitable polymeric coating. A bare core having no layer 32 can also include, for example, anodized aluminum or copper.

Figure 4:
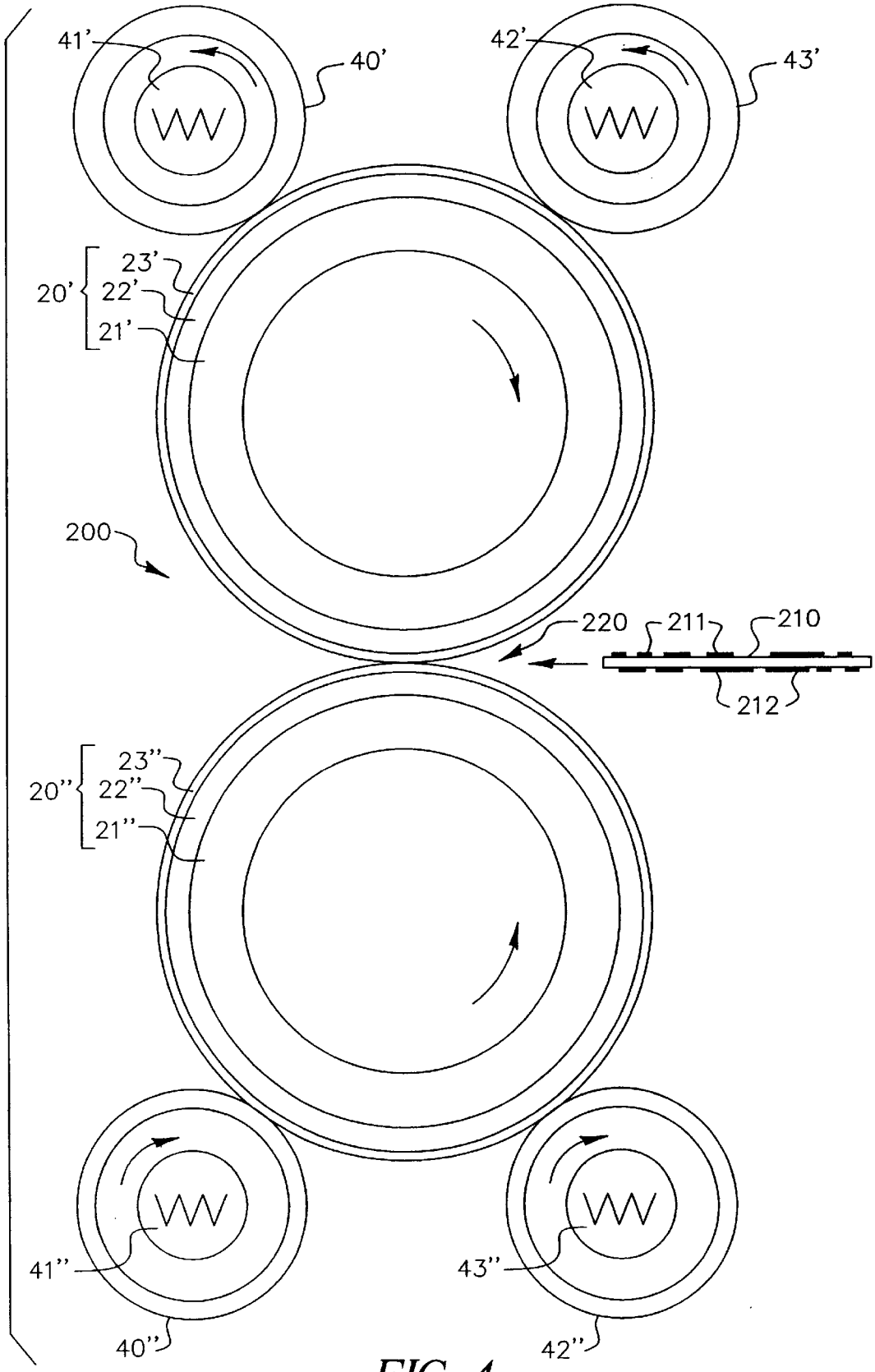
FIG. 4 depicts an end view of a duplex toner fusing station which includes a preferred externally-heated first fuser roller engaged in a fusing nip with a preferred externally-heated second fuser roller in accordance with the invention.

A preferred embodiment of an inventive duplex fusing station is indicated by the numeral 200 in FIG. 4. A first rotating fuser roller shown rotating clockwise and indicated as 20' preferably includes a rigid cylindrical core 21', a base cushion layer 22' surrounding the core, and a toner release layer 23' coated on the BCL 22'. A barrier layer (not shown) can be interposed between layers 22' and 23'. A second counter-rotating fuser roller 20" forms a fusing nip 220 with the first fuser roller 20'. The second fuser roller has the same structure as the first fuser roller, i.e., includes a rigid cylindrical core 21", a base cushion layer 22" surrounding the core, and a toner release layer 23" coated on the BCL 22". The second fuser roller 20" is similar to the first fuser roller 20'. Both rollers have characteristics generally similar to those of roller 20, and the singly-primed and doubly-primed entities of FIG. 4 correspond to like entities labeled by unprimed numerals in FIG. 2. However, the two fuser rollers 20' and 20" can differ somewhat in specific dimensions, such as for example roller diameters, layer thicknesses, and so forth, and can also differ somewhat in specific choices of materials and material properties. Each of the fuser rollers is heated by an external source of heat, such as for example can be provided by contact with one or more heating rollers, indicated as 40' and 42' for roller 20' and 40" and 42" for roller 20", with corresponding sources of heating indicated as internal incandescent lamps 41', 43', 41" and 43", respectively. Alternatively, the heat sources to heat rollers 20' and 20" can be external radiation absorbed by the fuser rollers, e.g., as provided by one or more radiation sources, or by any other suitable external heating sources. A receiver sheet 210 is shown approaching fusing nip 220. On each side of the receiver is an unfused toner image, labeled 211 and 212, respectively. After passing through the nip, the toner images are fused to the receiver sheet.

In another preferred embodiment of a duplex fusing station (not illustrated), rollers 20' and 20" are replaced by rollers that have structures and preferred ranges of dimensions and characteristics which are the same as those of roller 50 of FIG. 1.

Figure 5:
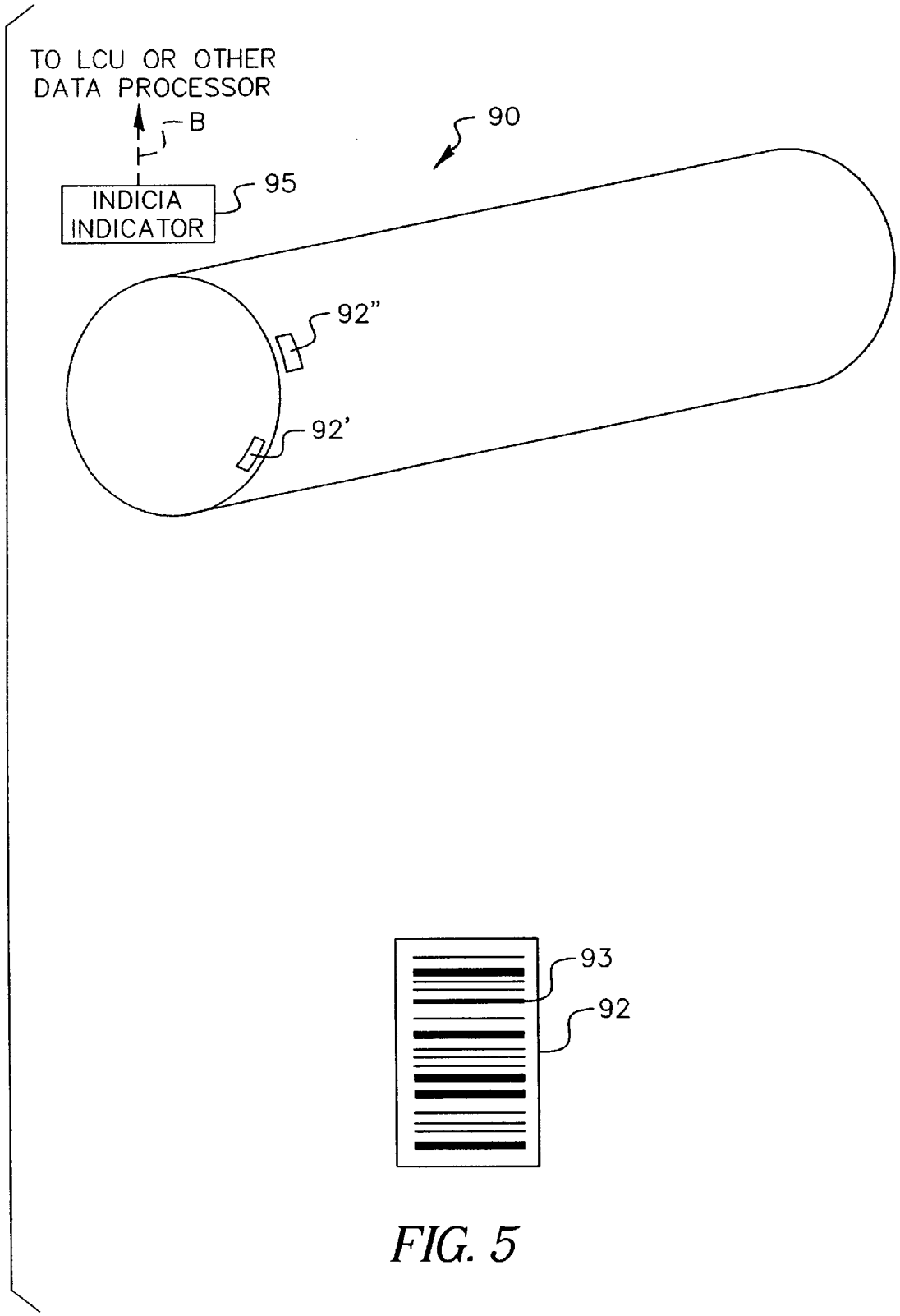
FIG. 5 is a sketch of the outside of a fuser roller having marked on its outer surface a descriptive indicia located in a small area located close to an end of the roller in accordance with the invention.

FIG. 5 shows a sketch of an inventive fuser roller, indicated as 90, on which the outer surface has marked on it a set of descriptive markings or indicia which are provided to indicate a parameter relative to the roller. The outer surface can correspond to an outer surface of a roller 90 including a sleeve member, in which case the outer surface of the roller is the outer surface of the sleeve member. The indicia are located in a small area 92" located on a portion of the cylindrical surface close to an end of the roller. More preferably, the indicia are contained in a small area 92' located on an end portion of the roller, with area 92' preferably near the edge or rim (the individual layers including roller 90 are not shown). In the case of 90 being a sleeved roller, area 92' is preferably located on the edge of the sleeve. An enlarged view 92 of either of the small areas 92' or 92" illustrates that the descriptive indicia can be in the form of a bar code, as indicated by the numeral 93, which can be read, for example, by a scanner. The scanner can be mounted in an electrophotographic machine so as to monitor an inventive fuser roller, e.g., during operation of the machine or during a time when the machine is idle, or the scanner can be externally provided during installation of, or during maintenance of, an inventive roller. Generally, the indicia can be read, sensed or detected by an indicia detector 95. As indicated in FIG. 13 by the dashed arrow labeled B, the analog or digital output of the indicia detector can be sent to a logic control unit (LCU) incorporated in an electrostatographic machine utilizing an inventive fuser roller, or it can be processed externally, e.g., in a portable computer during the installation or servicing of an inventive fuser roller, or it can be processed in any other suitable data processor. The indicia can be read optically, magnetically, or by means of radio frequency. In addition to a bar code 93, the indicia can include any suitable markings, including symbols and ordinary words, and can be color coded. The indicia can also be read visually or interpreted by eye. A color coded indicia on a roller can include a relatively large colored area which can be otherwise devoid of markings or other features and which can readily be interpreted by eye to indicate a predetermined property of the color-coded roller. A thermally induced change of the indicia can be used to monitor the life of an inventive fuser roller. For example, a color of an indicia of a color-coded inventive fuser roller could be chosen to have a thermally induced slow fade rate, or a thermally induced slow rate of change of an initial, e.g., as-manufactured, color, whereby a fading or otherwise thermally induced color change could be used as a measure of elapsed life or as a measure of remaining life of the roller. Such a color change can be monitored by eye. Preferably, the color change is measured by means of a reflected light beam, e.g., by using a densitomer or spectrophotometer, or any other suitable means of measuring the intensity or color of light reflected from the indicia, with the reflected optical information provided to a LCU or other computer. An indicia can also be utilized to measure the wear rate of an inventive fuser roller, e.g., by providing a portion of the indicia having a predetermined wear rate. The wear rate of an indicia can be measured optically, e.g., by monitoring the reflection optical density of a portion of the indicia which can be subject to wear, or by other suitable means. Suitable materials for the indicia are for example inks, paints, magnetic materials, reflective materials, and the like, which can be applied directly to the surface of the roller. Alternatively, the indicia can be located on a label that is adhered to the outer surface of the roller. The indicia can also be in raised form or produced by stamping with a die or by otherwise deforming a small local area on the outer surface of the roller, and the deformations can be sensed mechanically or otherwise detected or read using an indicia detector 95 in the form of a contacting probe or by other mechanical means.

Different types of information can be encoded or recorded in the indicia. For example, the outside diameter of a roller can be recorded so that nip width parameters can be accordingly adjusted. For example, the operating temperature range and operating fusing nip pressure can be recorded in the indicia The date of manufacture of the roller can be recorded in the indicia for diagnostic purposes, so that the end of useful life of the roller could be estimated for timely replacement. Specific information for each given roller regarding the roller runout, e.g., as measured after manufacture, can also be recorded in the indicia.

It is preferred to provide an indicia on the outer surfaces of rollers 10, 50, 60, 70, and 80 according to the manner described above for an inventive fuser roller 90, which can include a sleeved roller. In the case of a sleeved roller, it can also be useful to provide an indicia on an inner surface of a sleeve member, or on the surface of the core member. When an indicia is provided on the core member, it can also be useful to provide an opening or cutaway in the sleeve member to allow the indicia to be detected with the sleeve member in operational position on the core member.

It will be evident that the indicia according to the invention are distinguished from information stored electronically as described by M. E. Beard et al., U.S. Pat. No. 6,016,409, which discloses a module that includes an electronically-readable memory whereby the control system of the printing apparatus reads out codes from the electronically readable memory. According to the present invention, an indicia includes a physical alteration of the surface of a roller 90 and does not include electronic information as such, even though after detection by the indicia detector 95 the detected information can be subsequently converted to electronic form, e.g., in a computer.

In the above disclosed preferred embodiments of inventive simplex and duplex fusing stations, the use of overdrive-controlling layers in compliant fuser rollers results in low rates of wear, especially of fuser rollers in contact with relatively hard and abrasive receivers such as paper. Large scale image defects, e.g., wrinkling, and image smear during fusing are also reduced and image quality thereby increased.

In accordance with the foregoing description, it should be apparent that the inventors have described the invention as detailed in the following numbered paragraphs.

1. A deformable externally heated toner fuser roller, for use in a fusing station of an electrostatographic machine including:
   a rigid cylindrical core member;
   an overdrive-controlling elastically deformable structure surrounding the core member; and
   wherein the fuser roller is adapted to be heated by a heat source external to the roller and the overdrive-controlling, elastically deformable structure includes an effective or operational Poisson's ratio between 0.2 and 0.4.
2. The toner fuser roller according to Paragraph 1 wherein the overdrive-controlling, elastically deformable structure further includes an effective or operational Poisson's ratio in a range between 0.25 and 0.35.
3. The toner fuser roller according to Paragraph 1 wherein the overdrive-controlling elastically deformable structure further includes an effective or operational Young's modulus between 0.05 MPa and 50 MPa.
4. The toner fuser roller according to Paragraph 3 wherein the overdrive-controlling, elastically deformable structure further includes an effective or operational Young's modulus between about 0.1 MPa and 10 MPa.
5. The toner fuser roller according to Paragraph 1 wherein the overdrive-controlling, elastically deformable structure further includes a thickness between 2 mm and 25 mm.
6. The toner fuser roller according to Paragraph 5 wherein the overdrive-controlling, elastically deformable structure further includes a thickness between 4 mm and 12 mm.
7. The toner fuser roller according to Paragraph 1 wherein the overdrive-controlling, elastically deformable structure further includes a thermal conductivity in a radial direction of less than 0.5 BTU/hr/ft/° F. within a nip zone with a pressure roller.
8. A deformable, externally heatable toner fuser roller, for use in a fusing station of an electrostatographic machine, including:
   a rigid cylindrical core member;
   an elastically conformable base cushion layer adhered to the core member;
   an elastically compliant toner release layer adhered to the conformable base cushion layer; and
   wherein the conformable base cushion layer has a Poisson's ratio less than about 0.35 and the toner release layer has a Poisson's ratio greater than about 0.4.
9. The toner fuser roller according to Paragraph 8 wherein the conformable base cushion layer has a Poisson's ratio between 0.25 and 0.35.
10. The toner fuser roller according to Paragraph 9 wherein the conformable base cushion layer has a Poisson's ratio between 0.25 and 0.29.
11. The toner fuser roller according to Paragraph 8 wherein the compliant toner release layer has a Poisson's ratio between 0.45 and 0.50.
12. The toner fuser roller according to Paragraph 11 wherein the compliant toner release layer has a Poisson's ratio between 0.48 and 0.50.
13. The toner fuser roller according to Paragraph 8 wherein the said overdrive-controlling elastically deformable structure further includes an optional, thin, flexible, barrier layer interposed between and adhering to both the elastically conformable base cushion layer and the elastically compliant toner release layer.
14. The toner fuser roller according to Paragraph 1 wherein:
    the overdrive-controlling elastically deformable structure is adhered to a seamless tubular strengthening band which is in intimate nonadhesive contact with the core member; and,
    the strengthening band and the overdrive-controlling elastically deformable structure together form a seamless tubular replaceable removable sleeve member surrounding the core member.
15. A fusing station of an electrostatographic machine including the toner fuser roller according to Paragraph 1 and a heat source including one or more heating rollers in direct contact with an external surface of the fuser roller.
16. The toner fuser roller according to Paragraph 8 wherein the conformable base cushion layer includes a foam having a solid phase in the form of an open-cell or closed-cell structure.
17. The toner fuser roller according to Paragraph 16 wherein the foam includes a felted foam.
18. The toner fuser roller according to Paragraph 8 wherein the Young's modulus of the compliant toner release layer is in a range of 0.05 MPa to 50 MPa.
19. The toner fuser roller according to Paragraph 18 wherein the Young's modulus of the compliant toner release layer is in a range of 0.1 MPa to 10 MPa.
20. The toner fuser roller according to Paragraph 8 wherein the thickness of the compliant toner release layer is in a range of 0.25 mm to 5 mm.
21. The toner fuser roller according to Paragraph 20 wherein the thickness of the compliant toner release layer is in a range of 0.25 mm to 1 mm.

22. The toner fuser roller according to Paragraph 8 wherein the compliant toner release layer has a thermal conductivity between 0.2 BTU/hr/ft/° F. and 0.5 BTU/hr/ft/° F.

23. The toner fuser roller according to Paragraph 8 wherein the Young's modulus of the conformable base cushion layer is in a range of 0.05 MPa to 50 MPa.

24. The toner fuser roller according to Paragraph 23 wherein the Young's modulus of the conformable base cushion layer is in a range of 0.1 MPa to 10 MPa.

25. The toner fuser roller according to Paragraph 16 wherein the solid phase in the form of an open-cell or closed-cell structure has a Young's modulus in a range of 0.5 MPa to 500 MPa.

26. The roller according to Paragraph 25 wherein the solid phase in the form of an open-cell or closed-cell structure has a Young's modulus in a range of 1 MPa to 100 MPa.

27. The roller according to Paragraph 8 wherein the thickness of the conformable base cushion layer is between 0.5 mm and 25 mm.

28. The roller according to Paragraph 27 wherein the thickness of the conformable base cushion layer is between 1.25 mm and 12.5 mm.

29. The roller according to Paragraph 8 wherein the Young's modulus of the conformable base cushion layer is of the same order of magnitude as the Young's modulus of the compliant toner release layer.

30. The toner fuser roller according to Paragraph 8 wherein the conformable base cushion layer has a thermal conductivity in a radial direction of less than 0.4 BTU/hr/ft/° F. within the nip.

31. The toner fuser roller according to Paragraph 30 wherein the conformable base cushion layer has a thermal conductivity in a radial direction of between 0.1 BTU/hr/ft/° F. and 0.3 BTU/hr/ft/° F. within the nip.

32. The toner fuser roller according to Paragraph 8 wherein the conformable base cushion layer includes a poly(dimethylsiloxane) elastomer, a fluoroelastomer or an EPDM rubber.

33. The toner fuser roller according to Paragraph 8 wherein the conformable base cushion layer includes a polyimide elastomer.

34. The toner fuser roller according to Paragraph 8 wherein the base cushion layer further includes a particulate filler.

35. The toner fuser roller according to Paragraph 8 wherein the compliant toner release layer includes a fluoroelastomer or a silicone rubber.

36. The toner fuser roller according to Paragraph 8 wherein the compliant toner release layer further includes a particulate filler.

37. The toner fuser roller according to Paragraph 36 wherein said particulate filler in the compliant toner release layer is selected from the group consisting of aluminum oxide, iron oxide, calcium oxide, magnesium oxide, nickel oxide, tin oxide, zinc oxide, copper oxide, titanium oxide, silicon oxide, graphite, and mixtures thereof.

38. The toner fuser roller according to Paragraph 36 wherein said particulate filler includes 5 to 50 volume percent of said compliant toner release layer.

39. The toner fuser roller of Paragraph 13 wherein the thin barrier layer includes a fluoroelastomer plus 20 to 40 volume percent of a particulate filler, wherein the fluoroelastomer is preferably a random copolymer formed from mixtures of monomer units selected from vinylidene fluoride, tetrafluoroethylene, and hexafluoropropylene, and the filler includes aluminum oxide, iron oxide, calcium oxide, magnesium oxide, nickel oxide, tin oxide, and mixtures thereof.

40. The toner fuser roller of Paragraph 39 wherein said barrier layer has a thickness in a range of 10 micrometers to 50 micrometers.

41. A simplex fusing station of an electrostatographic machine, including:
a rotating externally heated deformable fuser roller;
a counter-rotating hard pressure roller engaged to form a toner fusing nip with the deformable fuser roller;
wherein said deformable fuser roller further includes:
a rigid cylindrical core member; and,
an overdrive-controlling elastically deformable structure surrounding the core member, the elastically deformable structure having an effective or operational Poisson's ratio of less than 0.35, an effective or operational Young's modulus between 0.05 MPa and 50 MPa, a thickness between 2 mm and 25 mm, and a thermal conductivity in a radial direction of less than 0.5 BTU/hr/ft/° F. within the fusing nip zone.

42. A simplex fusing station of an electrostatographic machine, including:
a rotating externally heated deformable fuser roller;
a counter-rotating hard pressure roller engaged to form a toner fusing nip with the deformable fuser roller;
wherein the fuser roller further includes:
a rigid cylindrical core member; and,
an elastically conformable base cushion layer adhered to the core member, the base cushion layer having a Poisson's ratio less than 0.35, a thickness between 0.5 mm and 25 mm, a Young's modulus between 0.05 MPa and 50 MPa, a thermal conductivity in a radial direction of less than 0.4 BTU/hr/ft/° F. within the nip;
an optional thin flexible barrier layer adhered to the base cushion layer; and,
an elastically compliant toner release layer adhered to the barrier layer, the toner release layer having a Poisson's ratio greater than 0.4, a Young's modulus in a range of 0.05 MPa to 50 MPa, a thickness between 0.25 mm and 5 mm, and a thermal conductivity between 0.2 BTU/hr/ft/° F. and 0.5 BTU/hr/ft/° F.

43. A duplex fusing station of an electrostatographic machine, including:
a rotating externally heated first deformable fuser roller;
a counter-rotating second externally heated deformable fuser roller engaged to form a pressure fusing nip with the first fuser roller;
wherein both or either of the first and second fuser rollers further includes:
a rigid cylindrical core member; and,
an overdrive-controlling elastically deformable structure surrounding the core member,
the elastically deformable structure having an effective or operational Poisson's ratio of less than 0.35, an effective or operational Young's modulus between about 0.05 and 50 MPa, a thickness between 2 mm and 25 mm, and a thermal conductivity in a radial direction of less than 0.5 BTU/hr/ft/° F. within the fusing nip zone.

44. A duplex fusing station of an electrostatographic machine, including:
a rotating externally heated first deformable fuser roller;
a counter-rotating second externally heated deformable fuser roller engaged to form a pressure fusing nip with the first fuser roller;
wherein both or either of the first and second fuser rollers further includes:
a rigid cylindrical core member; and,
an elastically conformable base cushion layer adhered to the core member, the base cushion layer having a Poisson's ratio less than 0.35, a thickness between 0.5 mm and 25 mm, a Young's modulus between 0.05 and 50 MPa, a thermal conductivity in a radial direction of less than 0.4 BTU/hr/ft/° F. within the nip; and,
an optional thin flexible barrier layer adhered to the base cushion layer; and,
an elastically compliant toner release layer adhered to the barrier layer, the toner release layer having a Poisson's ratio greater than 0.4, a Young's modulus in a range of 0.05 MPa to 50 MPa, a thickness between 0.25 mm and 5 mm, and a thermal conductivity between 0.2 BTU/hr/ft/° F. and 0.5 BTU/hr/ft/° F.

45. A toner fusing method, for use in an electrostatographic machine, including:
forming a fusing nip by engaging a rotating externally heated deformable fuser roller and a counter-rotating hard pressure roller, one of the rollers being a driven roller and the other frictionally driven by pressure contact in the nip;
providing one or more heating rollers contacting and thereby heating the fuser roller;
forming an unfused toner image on a surface of a receiver sheet;
feeding the leading edge of the receiver into the nip and allowing the unfused toner image on the receiver sheet to pass through the fusing nip with the unfused toner image facing the fuser roller;
wherein the fuser roller further includes:
a rigid cylindrical core member; and,
an overdrive-controlling elastically deformable structure surrounding the core member, the elastically deformable structure having an effective or operational Poisson's ratio of less than 0.35, an effective or operational Young's modulus between 0.05 MPa and 50 MPa, a thickness between 2 mm and 25 mm, and a thermal conductivity in a radial direction of less than 0.5 BTU/hr/ft/° F. within the fusing nip zone.

46. A toner fusing method, for use in an electrostatographic machine, including:
forming a fusing nip by engaging a rotating externally heated deformable fuser roller and a counter-rotating hard pressure roller, one of the rollers being a driven roller and the other frictionally driven by pressure contact in the nip;
providing one or more heating rollers contacting and thereby heating the fuser roller;
forming an unfused toner image on a surface of a receiver sheet;
feeding the leading edge of the receiver into the nip and allowing the unfused toner image on the receiver sheet to pass through the fusing nip with the unfused toner image facing the fuser roller;
wherein the fuser roller further includes:
a rigid cylindrical core member;
an elastically conformable base cushion layer adhered to the core member, the base cushion layer having a Poisson's ratio less than 0.35, a thickness between 0.5 mm and 25 mm, a Young's modulus between about 0.05 MPa and 50 MPa, a thermal conductivity in a radial direction of less than about 0.4 BTU/hr/ft/° F. within the nip;
an optional thin flexible barrier layer adhered to the base cushion layer; and
an elastically compliant toner release layer adhered to the barrier layer, the toner release layer having a Poisson's ratio greater than 0.4, a Young's modulus in a range of 0.05 MPa to 50 MPa, a thickness between 0.25 mm and 5 mm, and a thermal conductivity between about 0.2 and 0.5 BTU/hr/ft/° F.

47A. The simplex fusing stations according to Paragraph 41 wherein the hard pressure roller includes a rigid cylindrical tube, optionally coated with an elastomer less than 1.25 mm thick including a fluoroelastomer or a silicone rubber.

47B. The simplex fusing stations according to Paragraph 42 wherein the hard pressure roller includes a rigid cylindrical tube, optionally coated with an elastomer less than 1.25 mm thick including a fluoroelastomer or a silicone rubber.

48A. The toner fusing methods according to Paragraph 45 wherein the hard pressure roller includes a rigid cylindrical tube, optionally coated with an elastomer less than 1.25 mm thick including a fluoroelastomer or a silicone rubber.

48B. The toner fusing methods according to Paragraph 46 wherein the hard pressure roller includes a rigid cylindrical tube, optionally coated with an elastomer less than 1.25 mm thick including a fluoroelastomer or a silicone rubber.

The invention has been described in detail with particular reference to certain preferred embodiments thereof, but it will be understood that variations and modifications can be effected within the spirit and scope of the invention.

What is claimed is:

1. A deformable toner fuser roller, for use in a fusing station of an electrostatographic machine comprising:
a rigid cylindrical core member;
an overdrive-controlling, elastically deformable structure surrounding the core member having a base cushion layer formed on the core member, an optional barrier layer adhered to the base cushion layer; and a toner release layer adhered to the barrier layer wherein the base cushion layer comprises a foam having a Poisson's ratio between 0.2 and 0.4, and the toner release layer has a Poisson's ratio greater than 0.4; and
wherein the fuser roller is adapted to be heated by a heat source external to the roller and the overdrive-controlling elastically deformable structure comprises an effective or operational Poisson's ratio between 0.2 and 0.4.

2. A roller according to claim 1 wherein the overdrive-controlling elastically deformable structure comprises an effective or operational Poisson's ratio between 0.25 and 0.35.

3. A roller according to claim 1 further comprising an indicia that provides a parameter relative to the roller, the indicia capable of being sensed either visually, mechanically, electrically, optically, magnetically, or by means of a radio frequency.

4. The deformable toner fuser roller of claim 1 wherein the overdrive-controlling elastically deformable structure surrounding the core member further comprises:

a base cushion layer formed on the core member;

an optional barrier layer adhered to the base cushion layer; and a toner release layer adhered to the barrier layer.

5. The deformable toner fuser roller according to claim 1 wherein the replaceable removable sleeve member further comprises:

a strengthening band;

a base cushion layer comprising a foam having a Poisson's ratio between 0.2 and 0.4 formed on the strengthening band;

an optional barrier layer adhered to the base cushion layer;

and a toner release layer having a Poisson's ratio greater than 0.4 adhered to the barrier layer.

6. The deformable toner fuser roller according to claim 1 wherein the overdrive-controlling elastically deformable structure surrounding the core member further comprises a replaceable removable sleeve member surrounding and in intimate nonadhesive contact with the core member.

7. A deformable toner fuser roller for use in a fusing station of an electrostatographic machine, comprising:

a rigid cylindrical core member;

a replaceable removable sleeve member surrounding and in intimate nonadhesive contact with the core member, the replaceable sleeve member further comprising a strengthening band, a base cushion layer formed on the strengthening band, and a stiffening layer surrounding and in intimate contact with the base cushion layer, and a toner release layer formed on the stiffening layer; and wherein the fuser roller is adapted to be heated by a heat source external to the roller.

8. The fuser roller of claim 7 wherein the base cushion layer further comprises a foam having a Poisson's ratio between 0.2 and 0.4, the toner release layer has a Poisson's ratio greater than 0.4, and the fuser roller is adapted to be heated by a heat source external to the roller.

9. A roller according to claim 7 further comprising:

an indicia located on an outer surface of the roller; and wherein the indicia are provided on the roller to indicate a parameter relative to the roller that can be sensed by an indicia detector, either visually, mechanically, electrically, optically, magnetically, or by means of a radio frequency.

10. A method of forming a deformable toner fuser roller, for use in a fusing station of an electrostatographic machine comprising the steps of:

providing a rigid cylindrical core member with an overdrive-controlling, elastically deformable structure surrounding the core member, wherein the overdrive controlling, elastically deformable structure is a replaceable removable sleeve member in nonadhesive contact with the core member;

adapting the fuser roller to be heated by a heat source external to the roller;

placing an indicia containing a parameter related to the fuser roller on a surface of the fuser roller.

11. The method of claim 10 wherein the providing step further comprises the overdrive-controlling elastically deformable structure having an effective Poisson's ratio between 0.2 and 0.4.

12. The method of claim 10 wherein the providing step further comprises the overdrive-controlling elastically deformable structure comprises an effective or operational Poisson's ratio between 0.25 and 0.35.

13. The method of claim 10 wherein the providing step further comprises an indicia that provides a parameter relative to the roller, the indicia capable of being sensed either visually, mechanically, electrically, optically, magnetically, or by means of a radio frequency.

14. The method of claim 10 wherein the providing step further comprises provides the overdrive-controlling elastically deformable structure surrounding the core member having:

a base cushion layer formed on the core member;

an optional barrier layer adhered to the base cushion layer; and a toner release layer adhered to the barrier layer.

15. The method of claim 14 wherein the providing step further comprises providing the base cushion layer having a foam with a Poisson's ratio between 0.2 and 0.4, and the toner release layer has a Poisson's ratio greater than 0.4.

16. The method of claim 10 wherein the step of providing the replaceable removable sleeve member further comprises:

a strengthening band;

a base cushion layer comprising a foam having a Poisson's ratio between 0.2 and 0.4 formed on the strengthening band;

an optional barrier layer adhered to the base cushion layer; and and a toner release layer having a Poisson's ratio greater than 0.4 adhered to the barrier layer.

17. The method of claim 10 wherein the step of placing further comprising the indicia being capable of either being read, sensed or detected.

18. The method of claim 7 wherein the step of placing further comprising the indicia being a bar code.

* * * * *